US007342194B2

(12) United States Patent
Karweik et al.

(10) Patent No.: US 7,342,194 B2
(45) Date of Patent: Mar. 11, 2008

(54) DUAL FUNCTION RESET OPERATOR FOR AN ELECTRICAL DEVICE

(75) Inventors: Roger E. Karweik, Wind Lake, WI (US); Frank J. Graninger, Wind Lake, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 201 days.

(21) Appl. No.: 11/028,453

(22) Filed: Jan. 3, 2005

(65) Prior Publication Data

US 2006/0144682 A1 Jul. 6, 2006

(51) Int. Cl.
*H01H 3/00* (2006.01)

(52) U.S. Cl. ..... 200/329; 200/17 R; 200/341; 200/1 R

(58) Field of Classification Search ..... 200/329, 200/50.02, 16 R–16 C, 17 R, 43.07, 341, 200/1 R, 1 B, 520
See application file for complete search history.

(56) References Cited

U.S. PATENT DOCUMENTS 3,930,214 A * 12/1975 Richards et al. ..... 337/72
6,180,899 B1 * 1/2001 Passow ..... 200/243
6,198,058 B1 * 3/2001 Graninger et al. ..... 200/50.02

FOREIGN PATENT DOCUMENTS

DE 3809144 A1 * 9/1989

* cited by examiner

*Primary Examiner*—K. Richard Lee
(74) *Attorney, Agent, or Firm*—Patrick S. Yoder; Alexander R. Kuszewski

(57) ABSTRACT

In certain embodiments, a system includes a mechanical actuator having a first member configured to engage a contact block to move a contact slide for a first distance between open and closed positions of an electrical contact pair. The mechanical actuator also has a second member configured to engage an auxiliary device to move an actuator for a second distance between first and second positions, wherein the first and second distances are substantially different from one another.

26 Claims, 6 Drawing Sheets

DUAL FUNCTION RESET OPERATOR FOR AN ELECTRICAL DEVICE

BACKGROUND OF THE INVENTION

The present invention relates generally to contact blocks (auxiliary contacts), overload relays, and other electronic control devices. More specifically, the present invention relates to actuation of multiple electronic control devices by a single mechanical force or actuation, e.g., a mechanical button.

Existing electronic control devices, such as contactors and overload relays, may be engaged or disengaged by electrical or mechanical actuators. Unfortunately, the actuators typically have different actuation distances. For example, a mechanically-actuated contact block may have an actuation distance of 4 mm, while a mechanically-actuated overload relay may have an actuation distance of 11 mm. Accordingly, an existing mechanical actuator may provide a single actuation distance of 4 mm, which is sufficient for the contact block but insufficient for the overload relay. Thus, the existing actuator is incapable of actuating more than one electronic control device, where the actuation distances are different from one another.

For these reasons, a technique is needed for actuating multiple devices having different distances of actuation.

SUMMARY OF THE INVENTION

In certain embodiments, a system includes a mechanical actuator having a first member configured to engage a contact block to move a contact slide for a first distance between open and closed positions of an electrical contact pair. The mechanical actuator also has a second member configured to engage an auxiliary device to move an actuator for a second distance between first and second positions, wherein the first and second distances are substantially different from one another.

BRIEF DESCRIPTION OF THE DRAWINGS

The foregoing and other advantages and features of the invention will become apparent upon reading the following detailed description and upon reference to the drawings in which.

DETAILED DESCRIPTION OF SPECIFIC EMBODIMENTS

Figure 1:
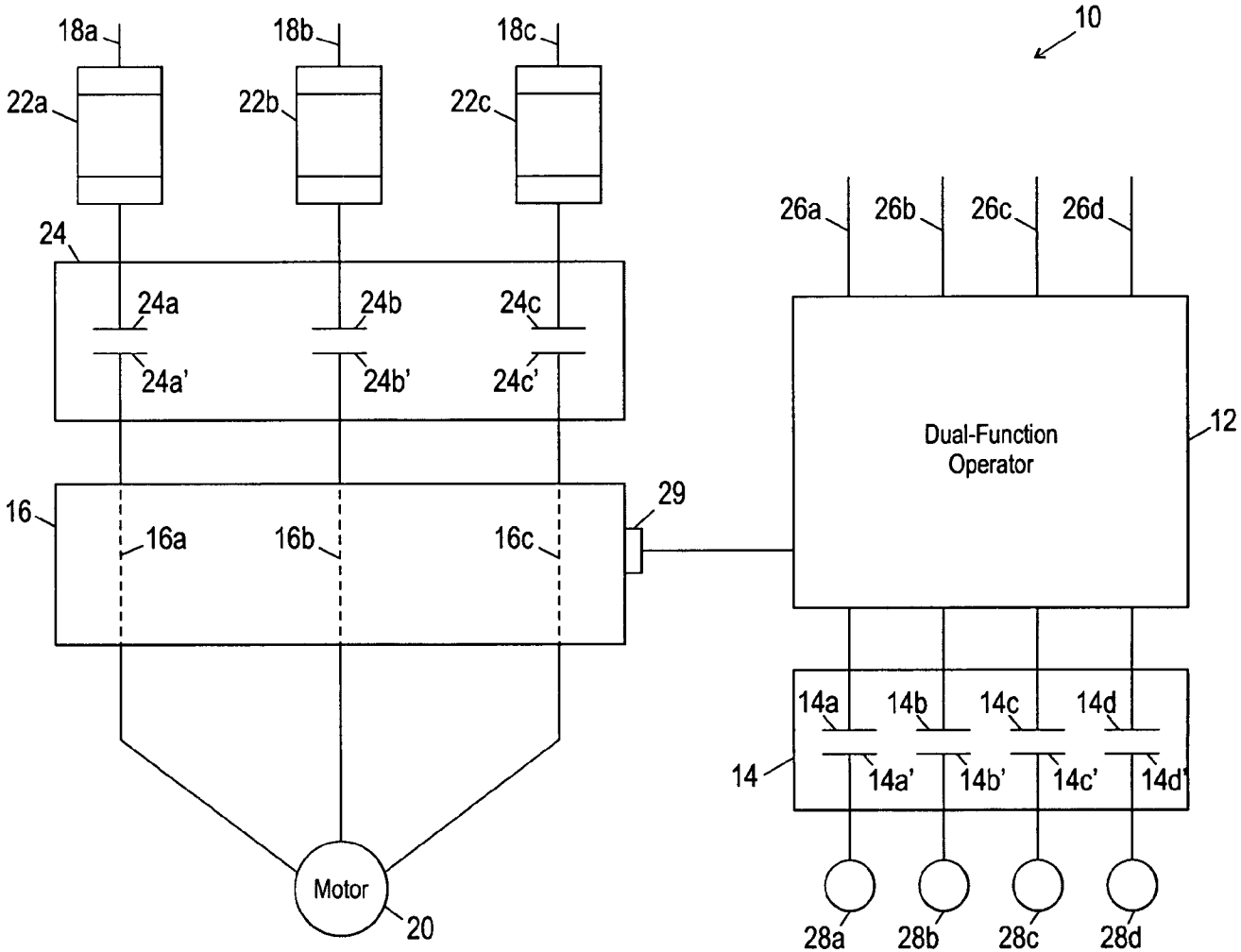
FIG. 1 is a diagrammatical illustration of a system having short-circuit protection devices, an overload relay, a contact block, and a dual-function operator in accordance with embodiments of the present technique.

FIG. 1 is a diagrammatical illustration of a system 10 having a dual-function operator 12 configured for mechanically actuating both a contact block 14 and an overload relay 16 in a single motion or engagement of the dual-function operator 12 in accordance with embodiments of the present technique. As illustrated, the system 10 includes three-phase power conductors 18*a*, 18*b*, and 18*c* connected to a motor 20 through short-circuit protection devices 22*a*, 22*b*, and 22*c* (e.g., circuit breakers, fuses, etc.), a contactor 24 (including contact pairs 24*a*/*a*', 24*b*/*b*', and 24*c*/*c*'), and the overload relay 16 (including relay paths 16*a*, 16*b*, and 16*c*). In addition, the system 10 includes conductors 26*a*, 26*b*, 26*c*, and 26*d* coupled to the contact block 14 at contact pairs 14*a*/*a*', 14*b*/*b*', 14*c*/*c*', and 14*d*,*d*', which in turn are coupled to auxiliary devices or status indicators 28*a*, 28*b*, 28*c*, and 28*d*, respectively. In certain embodiments, these auxiliary devices or status indicators 28*a*, 28*b*, 28*c*, and 28*d* comprise pilot lights, audible alarms, electronic signals to a remote computer or device, relays, and so forth. In operation, the overload relay 16 interrupts current flow upon detection of a fault condition by generating a trip signal which, in turn, causes an interruption in current flow through the power conductors 18*a*, 18*bc* and 18*c*. For example, such a trip signal may be used to de-energize the coil in a contactor connected in series with the power conductors 18*a*, 18*b* and 18*c*.

In the illustrated embodiment, a user may depress a button or generally engage the dual-function operator 12, which simultaneously moves one or more mechanisms to operate contact blocks (e.g., auxiliary contacts) 14 and the overload relay 16. In other words, mechanical engagement of the dual-function operator 12 mechanically resets the overload relay 16 and, also, electrically changes the state of auxiliary devices or status indicators 28*a*, 28*b*, 28*c*, and 28*d* by mechanically changing the state of the contact pairs 14*a*/*a*', 14*b*/*b*', 14*c*/*c*', and 14*d*,*d*' of the contact block 14. For example, as discussed in further detail below, the dual-function operator 12 is configured to provide mechanical force over a first range of travel (e.g., 4 mm) sufficient to move the contact pairs 14*a*/*a*', 14*b*/*b*', 14*c*/*c*', and 14*d*/*d*' from a normally open position to a closed position or, alternatively, from a normally closed position to an open position. In addition, the dual-function operator 12 is configured to provide mechanical force over a second range of travel (e.g., 11 mm) sufficient to move a button or actuator 29 on the overload relay 16. Although these first and second ranges of travel are different for the contact block 14 and the overload relay 16, the dual-function operator 12 is configured to provide a degree of travel (e.g., 7 mm) during which the contact pairs 14*a*/*a*', 14*b*/*b*', and 14*c*/*c*' are not being moved, yet the button or actuator of the overload relay 16 continued to be moved by the dual-function operator 12. In this manner, the dual-function operator 12 accommodates different ranges of travel of the contact block 14 and the overload relay 16, such that it can simultaneously actuate both the contact block 14 and the overload relay 16 by a single motion or depression of a button. In certain embodiments, the first and second ranges of travel are between about 1 to 8 mm and 5 to 15 mm, respectively. Accordingly, the difference between these first and second ranges of travel can be between 1 to 14 mm, or greater or lesser in other embodiments.

Figure 2:
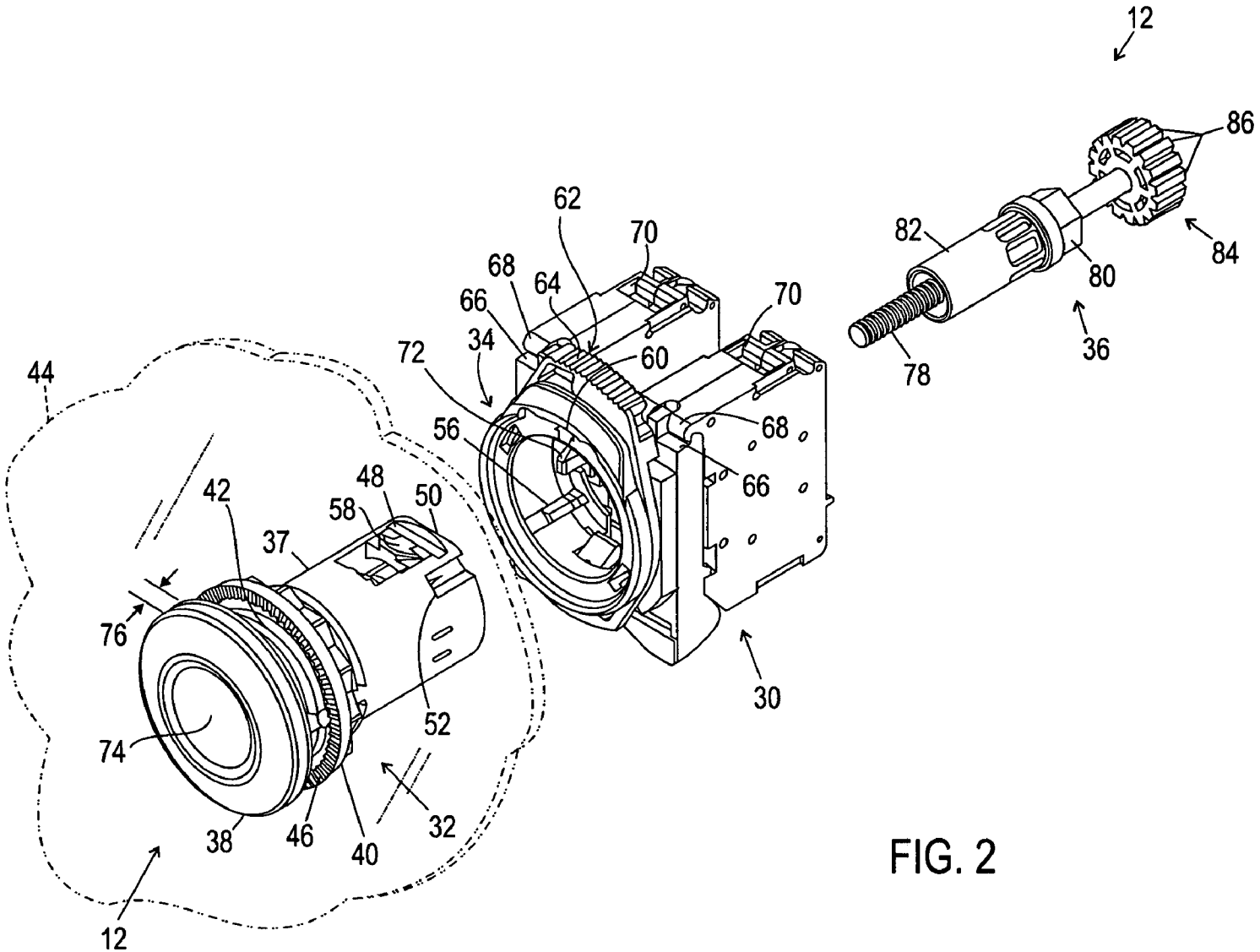
FIG. 2 is a front perspective view illustrating the dual-function operator exploded from a contact block in accordance with embodiments of the present technique.

FIG. 2 is a front perspective view of the dual-function operator 12 exploded from a contact block 30 according to embodiments of the present technique. As illustrated, the dual-function operator 12 includes a first or contact block operator 32, a mounting collar or latch assembly 34 configured to couple the contact block 30 to the first or contact block operator 32, and a second or reset operator 36 configured to extend through the contact block 30 and couple with the first or contact block operator 32.

The first or contact block operator 32 includes a variety of mounting structures and mechanisms, which facilitate mounting to external devices, machinery, control units, and so forth. For example, the first or contact block operator 32 includes a housing 37, a mounting flange 38 disposed at the front of the housing 37, and a mounting nut 40 secured to threads 42 adjacent the mounting flange 38. The first or contact block operator 32 can be mounted to a device or panel 44 by inserting the housing 37 through an opening in the panel 44, and then securing the mounting nut 40 to the threads 42. The mounting nut 40 also includes serrations 46 to engage the device or panel 44, thereby resisting retro-threading of the mounting nut 40 away from the surface of the panel 44.

In addition, the first or contact block operator 32 includes mechanisms for mounting with electronic control devices, such as the contact block 30. For example, the housing 37 of the first or contact block operator 32 includes an operator latch recess 48, an operator latch lip 50, and a pair of diametrically opposite guide slots and/or latch slots 52. These mechanisms 48, 50, and 52 are engageable with mating structures on the mounting collar or latch assembly 34, which in turn is coupled to the contact block 30 as discussed in further detail below. Specifically, a mating latch snaps into or latches with the operator latch recess 48 and/or lip 50 on the housing 37 of the first or contact block operator 32. In addition, the mounting collar or latch assembly 34 includes a pair of diametrically opposite guides 56, which extend into the guide slots 52 disposed on the first or contact block operator 32. The snap-fitting or latching of the housing 37 with the mounting collar or latch assembly 34 is further guided by directional indicators or arrow labels 58 and 60, which are disposed on the housing 37 and the mounting collar or latch assembly 34, respectively. When desired, the housing 37 can be released and separated from the mounting collar or latch assembly 34 by pushing a latch actuator 62 (assisted by grips or serrations 64) to rotate the latch assembly 34 relative to the housing 37. As the latch assembly 34 rotates, the mating latch rotates free from the latch recess 48 and the latch lip 50 disposed on the housing 37. The housing 37 can then be pulled free and separated from the latch assembly 34.

The mounting collar or latch assembly 34 is also removeably securable to the contact block 30 by one or more latching members. For example, the mounting collar or latch assembly 34 includes hook or latch members 66, which interlock with mating hook or latch members 68 on the contact block 30. The contact block 30 and latch assembly 34 also may include other latches, snap-fit mechanisms, or fasteners to secure the contact block 30 with the latch assembly 34 after engaging the hook or latch members 66 and 68. Accordingly, the contact block 30 can be attached and detached without the use of any tools by simply snapping together or disengaging the latch assembly 34 by rotating the collar 62. In other embodiments, a variety of latches, snaps, screws, bolts, hooks, adhesives, pins, or other fastening mechanisms can be used to secure the first or contact block operator 32 to the contact block 30.

The contact block 30 may have a variety of electrical and/or mechanical features and connectors as understood by those of skill in the art. In the illustrated embodiment, the contact block 30 includes a plurality of wire or conductor receptacles 70 to enable wires to be coupled to one or more internal electrical contact pairs, which are either normally open or normally closed. The contact block 30 also includes a contact slide assembly 72, which is moveable to change the position of the internal electrical contact pairs from normally open to closed or, alternatively, to move the position of the internal electrical contact pairs from normally closed to open. In the illustrated embodiment, the contact slide assembly 72 is moveable by an internal portion of the first or contact block operator 32 in response to movement or depression of a button or actuator 74 disposed in the mounting flange 38.

As discussed in further detail below, the button or actuator 74 has a range of movement that extends inside the device or panel 44, such that the mounting flange 38 can have a relatively low profile depth 76. For example, the low profile depth 76 may be on the range of 1 to 8 mm, e.g., 4.5 mm. Moreover, the range of movement of the button or actuator 74 can be greater than 4 mm, e.g., 5 to 20 mm, such that the button or actuator 74 substantially moves into and through the device or panel 44. In operation, movement of the button or actuator 74 moves the contact slide assembly 72 within the contact block 30, such that the electrical contact pairs are moved between open and closed positions, or vice versa. For example, the movement of contact slide assembly 72 may be between 1 and 8 mm, e.g., 4 mm. Simultaneously, the movement of the button or actuator 74 moves the threaded shaft 78 as illustrated in FIG. 4.

Advantageously, the threaded shaft 78, the lock nut 80, and the cylindrical member or sleeve 82 cooperatively facilitate positional adjustment of a head or second engagement portion 84 of the reset operator 36. In other words, the threaded shaft 78 can be threaded to a greater or lesser extent into the reset operator 36, thereby changing or adjusting the distance of the head or second engagement portion 84 relative to a reference, e.g., the contact block operator 32, an auxiliary device (e.g., overload relay), etc. In this manner, the adjustable distance can accommodate different ranges of movement desired for the head 84 to actuate an auxiliary device, such as an overload relay. The illustrated head 84 also includes ridges or gears 86 to facilitate rotation of the threads 78 into mating threads within the reset operator 32. In alternative embodiments, the housing 37 can include different structures, attachment mechanisms, and so forth.

Figure 3:
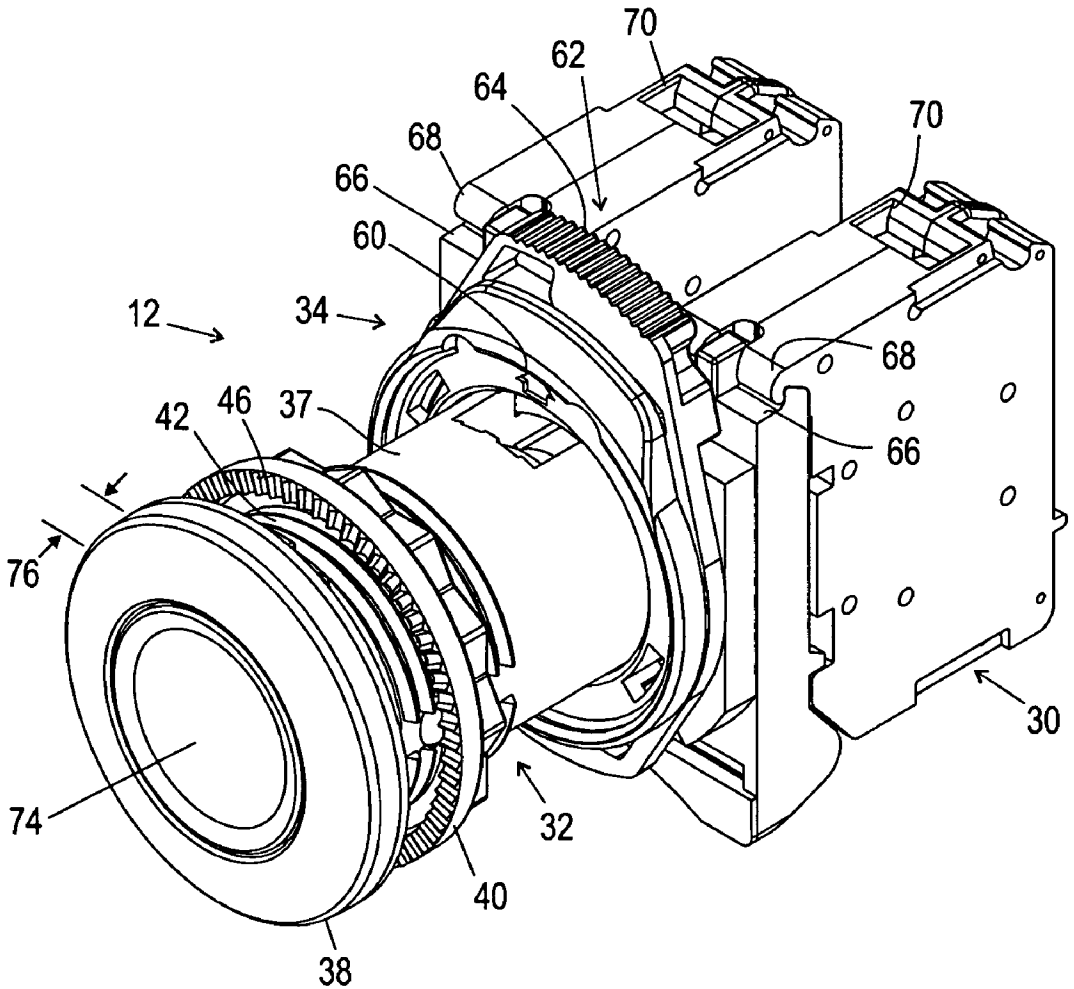
FIG. 3 is a front perspective view illustrating the dual-function operator assembled with the contact block illustrated in FIG. 2.

Turning now to FIG. 3, this figure is a perspective view of the dual-function reset operator assembly 12 illustrating the reset operator 32 coupled to the contact block 30 via the mounting collar or latch assembly 34 in accordance with embodiments of the present technique. As illustrated, the mating latch of the mounting collar or latch assembly 34 is latched or secured within the operator latch recess 48 and/or lip 50 within the housing 37 of the reset operator 32. To separate these components, the latch actuator 62 is pushed to rotate the mounting collar or latch assembly 34, thereby rotating the mating latch out of the operator latch recess 48 and/or lip 50. Upon freeing the mating latch from the recess 48 and/or lip 50, the reset operator 32 may be pulled apart and separated from the mounting collar or latch assembly 34 and the accompanying contact block 30. It also should be noted that additional contact blocks, similar to the contact block 30 may be stacked one after another adjacent the illustrated contact block 30. The dual-function reset operator assembly 12 can then be configured to actuate each of these stacked contact blocks 30 in addition to the auxiliary device (e.g. overload relay).

Figure 4:
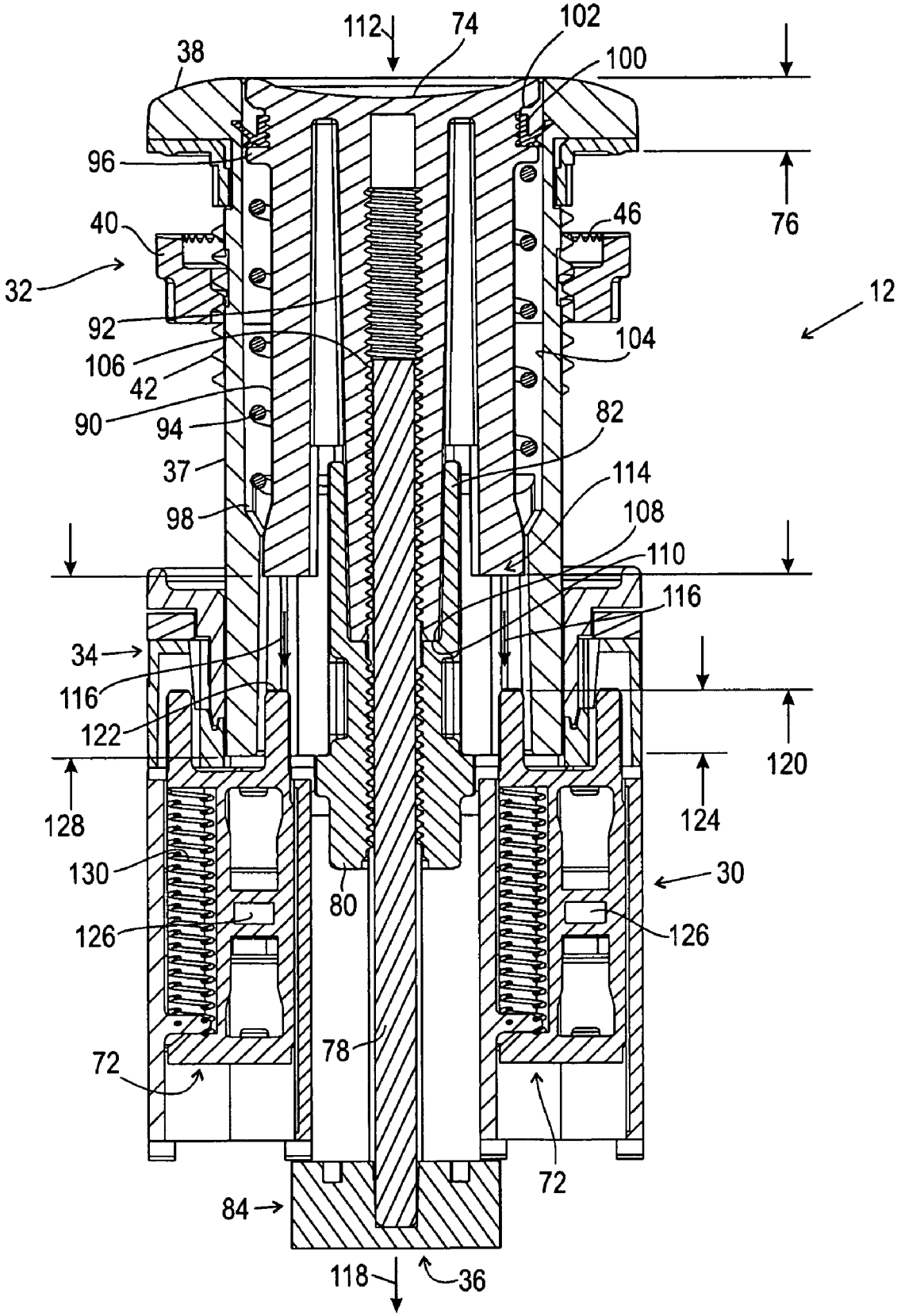
FIG. 4 is a cross-sectional side view illustrating the dual-function operator assembled with the contact block illustrated in FIG. 2.

FIG. 4 is a cross-sectional side view of the dual-function reset operator assembly 12 of FIGS. 2 and 3 illustrating the internal mechanics within the contact block 30, the reset operator 32, and the housing 37 in accordance with embodiments of the present technique. Referring first to the reset operator 32, the illustrated button 74 comprises a first annular structure 90 disposed about a second annular structure 92. The reset operator 32 also includes a spring 94 disposed between the first annular structure 90 and the housing 37. This spring 94 abuts against an annular lip 96 of the button 74, while engaging an annular catch 98 of the housing 37 at an opposite end of the spring 94. In this configuration, the spring 94 biases the button or actuator 74 outwardly toward the mounting flange 38 to a disengaged position of the button 74. The illustrated button 74 also includes a seal 100 disposed between an annular recess 102 in the mounting flange 38 and an annular interior surface 104 of the housing 37. During use of the dual-function operator 12, the seal 100 prevents water, dust, and other fluids and particulate from entering into the dual-function reset operator assembly 12.

Inside the second annular structure 92 of reset operator 32, the button 74 also includes internal threads or a threaded hole 106, which threadingly receives the threaded shaft 78 coupled to the head or second engagement portion (e.g., overload relay pusher). At an exterior end 108 of the second annular structure 92, an interior end 110 of the cylindrical member or sleeve 82 engages and abuts against the second annular structure 92. As discussed in detail above, the lock nut 80 may be rotated about the threaded shaft 78 to lock the cylindrical member or sleeve 82 against the second annular structure 92, thereby securing the threaded shaft 78 within the second annular structure 92. Again, the threaded shaft 78 may be threaded into the internal threads or threaded hole 106 of the second annular structure 92 to an adjustable length or distance before securement by the lock nut 80. Therefore, the position of the head or second engagement portion (e.g., overload relay pusher) 84 may be positioned at a desired distance relative to the dual-function reset operator assembly 12, thereby varying the distance of travel for engaging an auxiliary device, e.g. an overload relay.

When the button or actuator 74 is depressed as indicated by arrow 112, the dual-function reset operator assembly 12 begins to move an end or first engagement portion 114 of the first annular structure 90 as indicated by arrows 116. Simultaneously, movement of the button 74 begins to move the head or second engagement portion 84 as indicated by arrow 118. In certain application, this movement 118 of the head or second engagement portion 84 begins to move or actuate an auxiliary device, such as an overload relay, immediately or soon after initial engagement of the button or actuator 74. However, the end or first engagement portion 114 of the first annular structure 90 does not immediately engage the contact slide assembly 72 disposed within the contact block 30. Instead, the dual-function reset operator assembly 12 provides a range of non-actuating travel or pre-travel 120 between the first engagement portion 114 and a tip or mating portion 122 of the contact slide assembly 72. This range of pre-travel 120 is selected to provide additional travel to operate the auxiliary device, e.g. overload relay, by the head or second engagement portion 84.

Upon reaching the tip or mating portion 122 of the contact slide assembly 72, the first engagement portion 114 of the first annular structure 90 pushes the contact slide assembly 72 over a range of travel 124 to change positions or states of one or more contact pairs 126 riding on spanners disposed within the contact slide assembly 72. For example, the movement of the contact slide assembly 72 over the range of travel 124 may change the position of these contact pairs 126 from a normally open position to a closed position or, alternatively, from a normally closed position to an open position.

In addition to actuating the contact block 30, the additional movement over the range of travel 124 also continues to move the head or second engagement portion 84, thereby completing the actuation or operation of the auxiliary device, e.g. the overload relay. Altogether, a single motion or movement of the button 74 causes the first engagement portion 114 to actuate the contact block 30 over the range of travel 124, while also causing the head or second engagement portion 84 to actuate an auxiliary device, e.g. an overload relay, over a total range of travel 128 (e.g., the sum of ranges of travel 120 and 124). In certain embodiments, the auxiliary device may be actuated by less than the full range of travel 128, e.g., a part of the first range of travel 120 and a part of the second range of travel 124. For example, the auxiliary device may be offset by a distance from the head or second engagement portion 84, such that the auxiliary device is actuated by the range of travel 128 minus the offset distance. Other configurations are also within the scope of the present technique.

Upon release of the button or actuator 74, the spring 94 disposed within the first or contact block operator 32 biases the first and second annular structures 90 and 92 and the second or overload operator 36 outwardly toward a normal position having the button or actuator 74 disposed at the mounting flange 38. In addition, as the button or actuator 74 returns to its normal state, a spring within the contact slide assembly 72 biases the contact slide assembly 72 upwardly to its original position. Other spring configurations and return mechanisms are also within the scope of the present technique.

Figure 5:
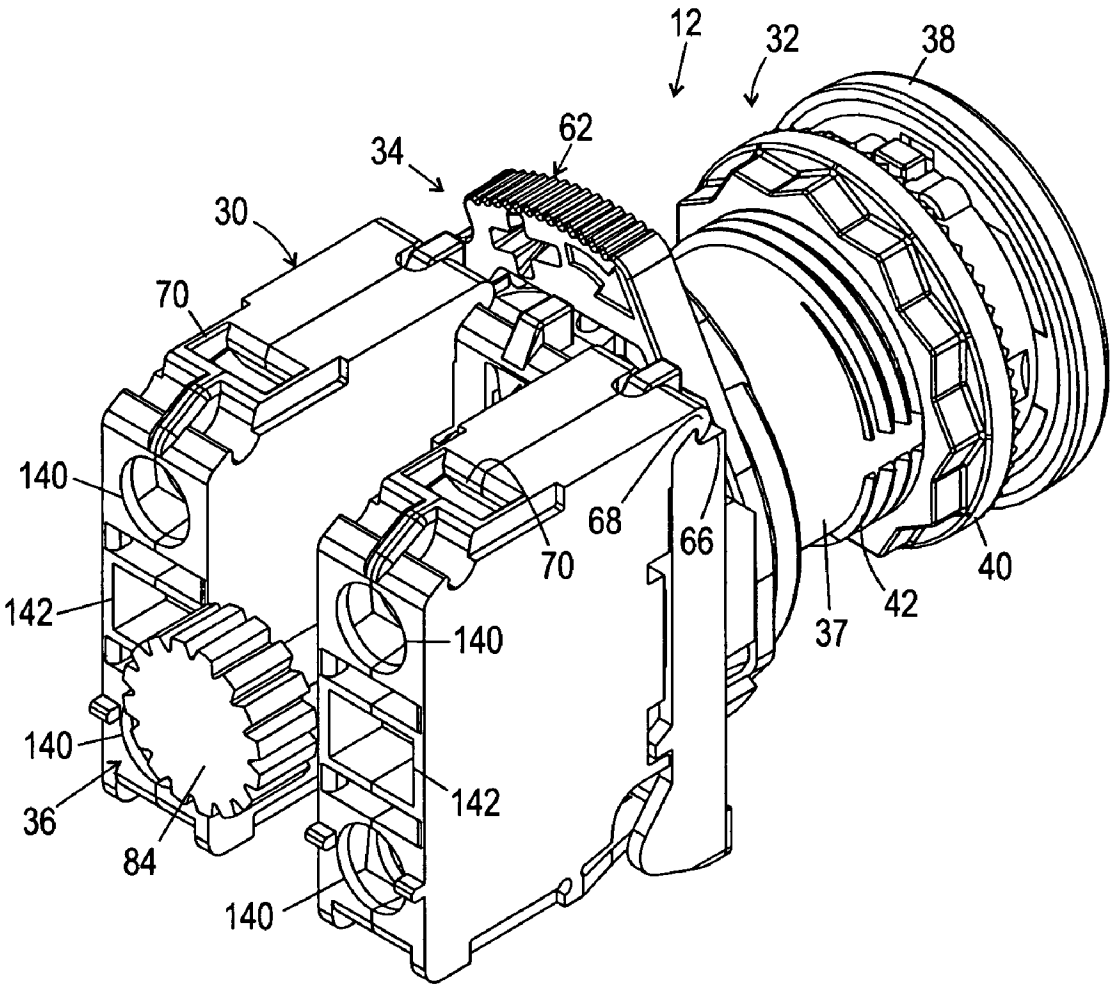
FIG. 5 is a rear perspective view illustrating the dual-function operator assembled with the contact block illustrated in FIG. 2.

FIG. 5 is a rear perspective view of the dual-function reset operator assembly 12 coupled to the contact block 30 illustrating various receptacles in a rear portion of the contact block 30 in accordance with embodiment of the present technique. As illustrated, the contact block 30 includes a plurality of screw or fastener receptacles 140 to receive screws or fasteners, which secure wires or conductors received in the receptacles 70 on top and bottom portions of the contact block 30. In addition, the contact block 30 includes contactor stacking receptacles 142, which are configured to receive protruding portions of contact slide assemblies of additional contact blocks being stacked one after the other behind the illustrated contact block 30. Accordingly, when the button 74 is engaged as described in detail above, the contact slide assemblies within each of these stacked contact blocks are engaged to change the position of the internal electrical contact pairs. If contact blocks are stacked in this manner, then the second or overload operator 36 may also be lengthened to accommodate the accumulative length of the multiple stacked contact blocks. In addition, as discussed in detail above, the second engagement portion 84 may be threadingly adjusted to a desired position relative to the first or contact block operator 32 or relative to another fixed reference on the assembly 12. The length of the threaded shaft 78 and/or the second engagement portion 84 also may be selected to vary the position of the engagement portion 84 relative to a reference, e.g., the contact block operator 32. In this manner, the head or second engagement portion 84 engages an auxiliary device, e.g., an overload relay, at a desired position and over a desired range of actuating travel.

Figure 6:
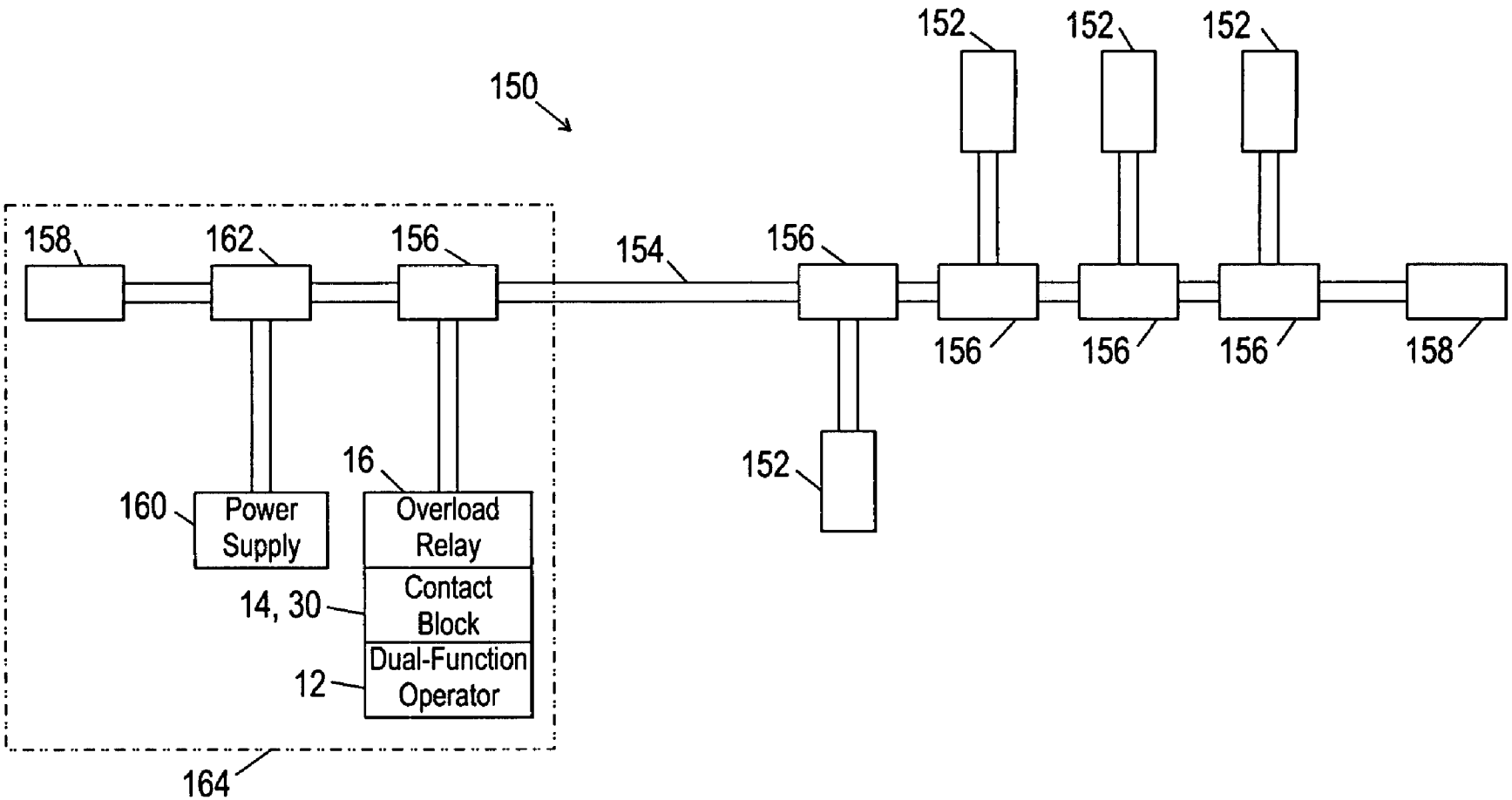
FIG. 6 is a diagrammatical illustration of a network having a dual-function operator in accordance with embodiments of the present technique.

Turning now to FIG. 6, the dual-function operator 12 is particularly suited for use in a networked industrial control system. As illustrated, the networked system is a data and power network, designated generally by the reference numeral 150, in which a plurality of device nodes 152 are interconnected by a network cable 154. Each device node 152 receives power and data signals from cable 154 via a tap connector 156. Terminators 158 are provided at the ends of cable 154 for capping and electrically terminating the power and data conductors of the cable.

Each device node 152 typically may include a networked sensor or actuator unit, as can be appreciated by those skilled in the art. Depending upon the particular application (e.g., an industrial control system) in which network 150 is installed, nodes 152 may include such devices as push-button switches, proximity sensors, flow sensors, speed sensors, actuating solenoids, overload relays, etc. The nodes 152 can be coupled to network cable 154 in a variety of topologies, including branch drop structures, zero drop connections, short drop connections, and daisy chain arrangements.

As can be appreciated by those skilled in the art, each node 152 can transmit and receive data signals via the data conductors of cable 154 in accordance with various standard protocols. For example, the data conductors can conduct pulsed data signals in which levels of electrical pulses are identified by the nodes as data representative of node addresses and parameter information. Each node device generally is programmed to recognize data signals transmitted over cable 154 that are required for executing a particular node function. Hardware and software of generally known types are provided at sensing nodes for encoding sensed parameters and for transmitting digitized data signals over cable 154 representative of a node address and of a value of the sensed parameters.

Cable 154 also includes power conductors for providing electrical power to nodes 152. For example, the power conductors may form a direct current bus of predetermined voltage, such as 24 VDC. Electrical power is applied to the power conductors by power supply circuits, such as a power supply 160, electrically connected to the power conductors of cable 154 via power taps, such as a power tap 162. The configuration and circuitry for such power supply circuits are generally known in the art. Each power tap 162 may include protective devices, such as fuses, that may be removed from the power taps to isolate a portion of the network if desired.

As illustrated in FIG. 6, a device node (i.e., dual-function reset operator assembly 12, contact blocks 14, and overload relay 16) may be positioned within an enclosure 164 along with power supply 160, power tap 162, and terminator 158. The dual-function reset operator assembly 12, contact blocks 14, and overload relay 16 are coupled to the network cable 154 via tap connector 156. In a typical industrial application, enclosure 164 may be installed in a location in a factory readily accessible to operations and maintenance personnel, while other components of the network may be positioned in manufacturing, processing, material handling and other locations remote from the enclosure. A "remote" location may be a location in the same building as the enclosure or may be geographically remote, such as another building, city, state, or country.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system, comprising:

a mechanical actuator, comprising:

a first member configured to engage a contact block to move a contact slide for a first distance between open and closed positions of an electrical contact pair; and a second member configured to engage an auxiliary device to move an actuator for a second distance between first and second positions, wherein the first and second distances are substantially different from one another.

2. The system of claim 1, wherein the mechanical actuator comprises a spring-loaded button.

3. The system of claim 1, wherein the first distance is preceded by a third distance.

4. The system of claim 3, wherein the second distance comprises at least part of the first distance and at least part of the third distance.

5. The system of claim 1, comprising the contact block coupled to the mechanical actuator, wherein the second member comprises a shaft that extends though the contact block to a head.

6. The system of claim 1, comprising the contact block coupled to the mechanical actuator, wherein the contact block is configured to control at least one status indicator.

7. The system of claim 6, comprising a networked system of devices coupled to the overload relay.

8. The system of claim 1, comprising the auxiliary device having the actuator disposed adjacent the second member, wherein the auxiliary device comprises an overload relay.

9. The system of claim 1, wherein the first and second distances have a common distance configured to move the contact slide and the actuator at least partially simultaneously.

10. The system of claim 1, wherein the first and second members are coaxial with one another.

11. The system of claim 1, wherein the first and second members are configured to move along first and second linear paths of travel, respectively.

12. The system of claim 1, wherein the second member is at least partially exposed outside a housing of the mechanical actuator.

13. The system of claim 1, wherein the first member comprises a first range of free travel followed by a second range of actuating travel to move the contact slide for the first distance, and the second member comprises a third range of actuating travel comprising at least part of the first range of free travel and at least part of the second range of actuating travel to move the actuator for the second distance.

14. A mechanical actuator for actuating a plurality of devices having different distances of actuation, comprising:

a mechanical button having a range of travel in a direction;

a first member coupled to the mechanical button, wherein the first member has a first engagement portion having a first range of free travel followed by a second range of actuating travel configured for actuating a first device;

a second member coupled to the mechanical button, wherein the second member has a second engagement portion having a third range of actuating travel comprising at least part of the first range of free travel and at least part of the second range of actuating travel, the third range of actuating travel configured for actuating a second device different from the first device.

15. The mechanical actuator of claim 14, wherein the first device comprises a contact block coupled to a status indicator, and the second device comprises an overload relay.

16. The mechanical actuator of claim 14, wherein the second engagement portion is offset from the first engagement portion in the direction.

17. The mechanical actuator of claim 14, wherein the mechanical button is disposed in a mounting flange configured to mount to a panel, and the range of travel is substantially greater than a depth of the mounting flange.

18. The mechanical actuator of claim 14, wherein the first member comprises an annular structure disposed about the second member, and the second member comprises an elongated shaft.

19. The mechanical actuator of claim 14, comprising a housing disposed about the first and second members, and a spring disposed between the housing and the first member to bias the mechanical button to a disengaged position.

20. The mechanical actuator of claim 14, wherein the second member comprises a threaded shaft threadingly coupled to the mechanical button, such that the threaded shaft is configured to facilitate positional adjustment of the second engagement portion.

21. A method of actuating a plurality of devices having different distances of actuation, comprising:

providing a range of mechanical travel in response to physical actuation of a mechanical actuator, the range of mechanical travel including a first range of actuating travel and a second range of actuating travel, where the first and second ranges of actuating travel are substantially different from one another;

facilitating a first movement of a first actuator of a first device by mechanical force applied during the first range of actuating travel; and facilitating a second movement of a second actuator of a second device by mechanical force applied during the second range of actuating travel.

22. The method of claim 21, wherein facilitating movement comprises moving the first actuator in a contact block to change positions of an electrical contact pair by mechanical force applied by the mechanical actuator during the first range of actuating travel.

23. The method of claim 21, wherein facilitating movement comprises moving the second actuator disposed on an overload relay by mechanical force applied by the mechanical actuator during the second range of actuating travel.

24. The method of claim 21, wherein providing the range of mechanical travel comprises providing a range of non-actuating travel before or after the first range of actuating travel during which the second range of actuating travel is occurring.

25. The method of claim 21, wherein providing the range of mechanical travel comprises facilitating movement of a mechanical button of the mechanical actuator though a mounting structure configured to mount the mechanical actuator to a panel, the movement having the range of mechanical travel greater than a depth of the mounting structure and the panel.

26. The method of claim 21, wherein the first and second movements occur at least partially simultaneously.

* * * * *